United States Patent [19]

Feldl

[11] 4,027,655

[45] June 7, 1977

[54] FIREPLACE DAMPER RELEASE MECHANISM

[76] Inventor: Erich J. Feldl, 227 S. Wind Place, Manhattan, Kans. 66502

[22] Filed: Mar. 22, 1976

[21] Appl. No.: 669,050

[52] U.S. Cl. ..... 126/288; 49/2; 160/6; 236/1 G

[51] Int. Cl.² ..... F23L 11/00

[58] Field of Search ..... 2.36/1 G, 45; 431/20; 126/285 R, 285 B, 286, 288, 287.5; 110/163; 49/1, 2; 160/6

[56] References Cited

UNITED STATES PATENTS

| | | | |
|---|---|---|---|
| 2,665,683 | 1/1954 | Snook | 126/288 |
| 2,996,064 | 8/1961 | Haas | 126/288 |
| 3,134,377 | 5/1964 | Kanoy | 126/288 |

*Primary Examiner*—Ronald C. Capossela
*Attorney, Agent, or Firm*—Edwin H. Crabtree; John H. Widdowson

[57] ABSTRACT

A fireplace damper release mechanism for mounting in a fireplace adjacent a fire. The mechanism coacts with a fireplace damper connecting rod to automatically close the fireplace damper when the fire has gone out thereby avoiding the loss of heat from the room through the fireplace chimney.

5 Claims, 4 Drawing Figures

FIREPLACE DAMPER RELEASE MECHANISM

BACKGROUND OF THE INVENTION

This invention relates generally to fireplace accessories and more particularly, but not by way of limitation, to a fireplace damper release mechanism for automatically closing a fireplace damper.

Heretofore there have been a number of different types of thermostatic controls mounted in fireplaces for opening and closing the fireplace damper. These devices have been complex in design and have not been located in a fireplace to best sense fireplace temperature condition.

SUMMARY OF THE INVENTION

The subject invention is novel in structure yet simple in design and is easily mounted inside a fireplace for connecting to the existing fireplace damper.

The mechanism automatically closes the damper when the fire has gone out to prevent loss of heat from the room through the fireplace chimney.

When a fire in the fireplace is again desired, the fireplace damper is opened by raising the fireplace damper connecting rod and the rod is reset in the damper release mechanism to again automatically close the damper.

The fireplace damper release mechanism includes a mechanism housing for receiving a vertical lower end portion of the connecting rod. The lower end portion rests on top of a first bimetallic thermostatic metal strip. As the temperature in the fireplace increases, the strip flexes and pivots away from the bottom of the lower end portion of the rod. At this time the rod drops downward a very small distance and comes to rest on top of a second bimetallic thermostatic metal strip which prior to the flexing of the first metal strips has also flexed and pivoted from its normal position into a position directly below the bottom of the lower end portion of the rod. When the fire has gone out both metal strips flex and pivot back to their normal positions. The second metal strip when it returns to its normal position which is not directly below the vertical rod allows the rod to continue to drop closing the fireplace damper. When it is desired to start the fire again, the rod is lifted and the first metal strip pivots into its normal position directly below the rod and the connecting rod is received thereon to repeat the automatic release process.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
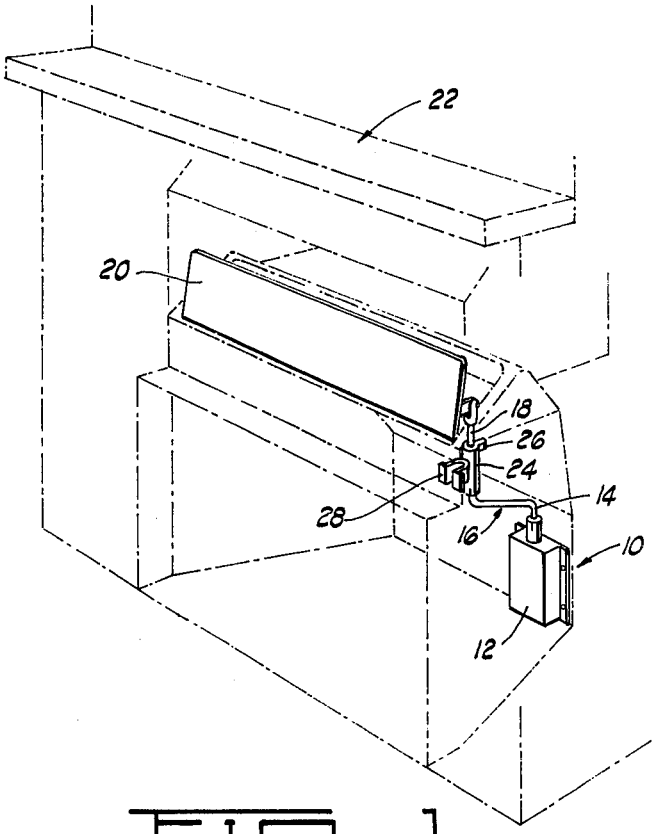
FIG. 1 is a perspective view with the fireplace damper release mechanism attached to the fireplace damper.

In FIG. 1 the fireplace damper release mechanism is designated by general reference numeral 10. The mechanism 10 includes a mechanism housing 12 for receiving a vertical lower end portion 14 of a fireplace damper connecting rod 16. The rod 16 further includes an upper end portion 18 attached to the fireplace damper 20. The damper 20 is shown pivotally mounted and in an open position in a fireplace 22. By raising and lowering the rod 16 manually the damper 20 can be opened and closed.

Also seen in this view is a rotatable sleeve 24 slidably mounted on the rod 16 and including a cam plate 26 integrally formed therein. By rotating the sleeve 24 on the rod 16 and positioning the cam plate 26 over a bracket 28 which is mounted to the fireplace 22, the damper 20 can be held in an open position. The cam plate 26 can also be positioned below the bracket 28 for holding the damper 30 in a closed position.

Figure 2:
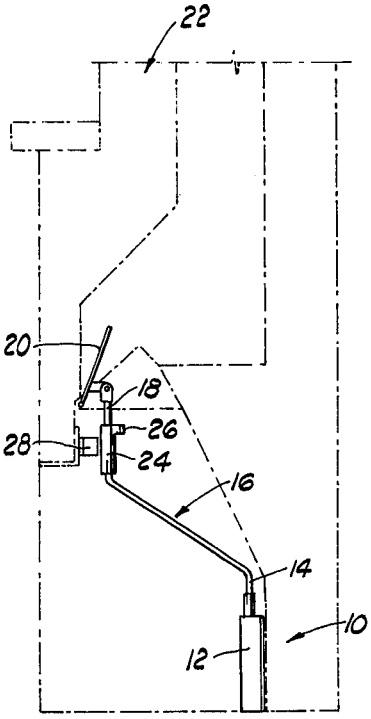
FIG. 2. is a side view of the fireplace as shown in FIG. 1.

In FIG. 2 a side view of the fireplace 22 is shown with the mechanism 10 disposed at the rear of the fireplace 22. The damper 20 is also shown in this view in an open position to allow the heat from the fireplace 22 to move upward through the chimney. When it is desired to automatically close the damper 20 using the mechanism 10, the sleeve 24 is turned in the position shown in FIG. 2 so that the cam plate 26 will not contact the bracket 28 as the rod 16 is lowered in the housing 12 which will be described under FIGS. 3 and 4.

Figure 3:
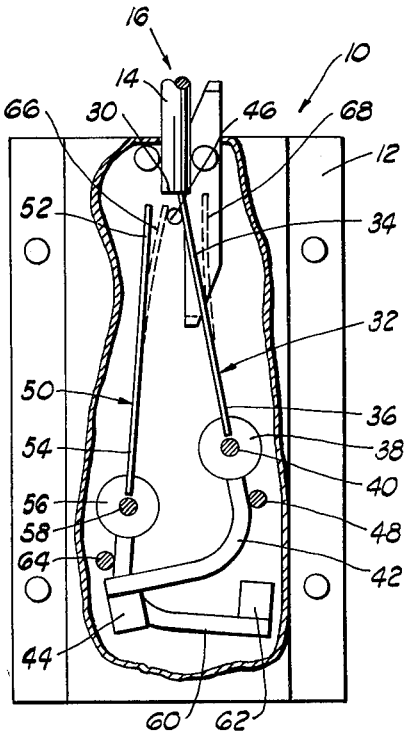
FIG. 3 is a front view having a partial cut-away section of the mechanism housing.

In FIG. 3 a portion of the vertical lower end portion 14 of the rod 16 is shown received in the top of the housing 12. A bottom 30 of the lower end portion 14 of the rod 16 rests on top of a first elongated bimetallic thermostatic metal strip 32. The metal strip 32 includes an upper end portion 34 and a lower end portion 36.

The lower end portion 36 of the metal strip 32 is attached to a first pivot block 38 having pivot pins 40 attached to the sides of the housing 12. Extending downwardly from the first pivot block 38 is a first L-shaped pivot arm 42 having a weight 44 attached thereto for pivoting the first metal strip 32 in a counterclockwise direction against stops 46 which are attached to the sides of the housing 12. The stops 46 position the upper end portion 34 of the first metal stop 32 in a vertical line directly below the lower end portion 14 of the rod 16. As the first pivot arm 42 pivots on pivot block 38, the arm 42 comes to rest against a stop 48.

Adjacent the first metal strip 32 is a second elongated bimetallic thermostatic metal strip 50 having an upper end portion 52 and a lower end portion 54. The lower end portion 54 of the second metal strip 50 is attached to a second pivot block 56 having pivot pins 58 attached to the sides of the housing 12.

Extending downwardly from the second pivot block 56 is a second L-shaped pivot arm 60 having a weight 62 attached thereto for pivoting the second metal strip 50 clockwise to a position which is offset to one side of the bottom 30 of the lower end portion 14 of the rod 16 and in a spaced relationship thereto. The second metal strip 50 is held in this position by the second pivot arm 60 resting against a stop 64.

In operation to starting a fire, the damper 20 is opened by lifting the rod 16. The first metal strip 34 is pivoted into position shown by the solid line in FIG. 3 by the weighted pivot arm 42, as described above. The bottom 30 of the lower end portion 14 of the rod 16 is then rested on the top of the first metal strip 32 thereby holding the damper 20 in an opened position.

A fire is started in the fireplace 22 and as the temperature in the fireplace 22 increases, the first and second metal strips 32 and 50 begin to flex. The second metal strip 50 is designed to flex at a lower temperature than the first metal strip 32. Therefore, as the temperature increases the second metal strip 50 flexes and the upper end portion 52 of the second metal strip 50 flexes clockwise into a position 66 shown in dotted lines. This new position 66 is directly below the bottom 30 of the lower end portion 14 of the rod 16 and in a spaced relationship thereto.

As the temperature continues to increase the first metal strip 32 begins to flex and the upper portion 34 of the first metal strip 32 flexes clockwise into a new position 68 shown in dotted lines and releases the lower end portion 14 of the rod 16. The rod 16 drops downward until it comes to a rest on top of the second metal strip 50 which is now in its new position 66. By the rod 16 dropping downward and now resting on the second metal strip 50, the damper 20 together with the connecting rod 16 are now supported by the flexed metal strip 50.

As the fire begins to go out and the temperature in the fireplace drops, the first metal strip 32 being more responsive to the higher temperature in the fireplace begins to flex with the upper portion 34 flexing counterclockwise toward its original position. But as mentioned above the lower end portion 14 of the rod 16 has now dropped downward and is resting on the second metal strip 50. Therefore, the upper portion 34 of the first metal strip 32 flexes and comes to rest against the side of the lower end portion 14 of the rod 16. As the first metal strip 32 continues to flex back to its original straight shape, the upper portion 34 rests against the side of the lower end portion 14 of the rod 16 and the arm 42 with its weight 44 pivots counterclockwise to allow continuing flexing of strip 32.

As the temperature of the fire continues to drop and the fire begins to go out, the second metal strip 50 being responsive to the lower temperature of the fireplace beings to flex with the upper portion 52 of the second metal strip 50 flexing counterclockwise toward its original position. At this point the lower portion 14 of the rod 16 is again released and the rod 16 drops downward in the housing 12 until the damper 20 completely closes. The fire has now gone out and the mechanism 10 now prevents the heat in the room from escaping up the chimney of the fireplace 22.

When a fire is again desired, the rod 16 is manually raised in the fireplace 22 and the weighted pivot arm 42 pivots the first metal strip 32 against the stops 46 and the rod 16 can now be lowered onto the top of the first metal strip 32 and the operation as described above is repeated.

Figure 4:
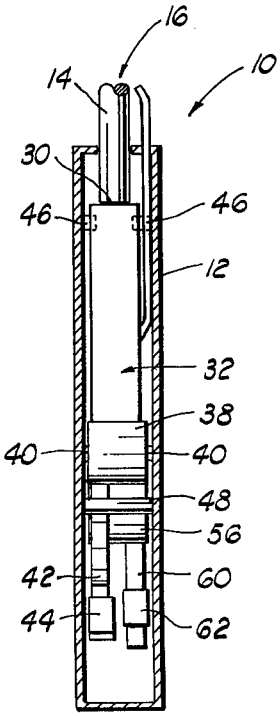
FIG. 4 is a side sectional view of the mechanism housing shown in FIG. 3.

In FIG. 4 a cutaway side view of the housing 12 is shown. In this view the metal strip 32 can be seen resting against the stops 46 that extend from each side of the housing 12. It should be noted that sufficient room is provided between the stops 46 to allow the lower end portion 14 of the rod 16 to drop downward and therebetween closing the damper 20 when the rod 16 is released by the second metal strip 50.

Changes may be made in the construction and arrangement of the parts or elements of the embodiments as disclosed herein without departing from the spirit or scope of the invention as defined in the following claims.

I claim:

1. A fireplace damper release mechanism for automatically allowing a damper to close after a fire has gone out in a fireplace, the damper including a fireplace damper connecting rod having an upper end portion and a vertical lower end portion, the upper end portion of the rod attached to the damper, the damper opened and closed by manually raising and lowering the rod, the mechanism comprising:

a housing mounted in the fireplace for receiving the lower end portion of the rod;

a first temperature sensitive release means pivotally mounted in said housing, the bottom of the lower end portion of the rod disposed directly above said first release means and resting thereon, the rod holding the damper in an open position while starting a fire in the fireplace, said first release means flexing with an increase in temperature away from the bottom of the lower end portion of the rod thereby allowing the rod to drop downward; and a second temperature sensitive release means pivotally mounted in said housing, said second release means constructed to flex more rapidly than said first release means when the temperature increases in the fireplace, said second release means positioned below the bottom and in a spaced relationship to one side of the lower end portion of the rod, said second release means flexing with an increase in temperature toward the center of the bottom of the lower end portion of the rod and directly below for receiving the rod thereon when the rod is released by said first release means;

said second release means flexing with a decrease in temperature when the fire is gone out in the fireplace and flexing away from the center of the bottom of the lower end portion of the rod thereby returning to its original position and allowing the rod to drop downwardly closing the fireplace damper.

2. The mechanism as described in claim 1 wherein said first release means is a first elongated bimetallic thermostatic metal strip, said second release means is a second elongated bimetallic thermostatic metal strip.

3. The mechanism as described in claim 2, wherein said first metal strip is mounted in a first pivot block and extends upwardly therefrom, said first pivot block having pivot pins attached to the sides of said housing, said first pivot block having a weighted L-shaped arm extending downwardly thereform for pivoting against a pivot stop attached to the sides of said housing, said weighted arm pivoting said pivot block and said first metal strip positioning said first metal strip directly below the bottom of the lower end portion of the rod for receiving the rod thereon, as the rod is raised together with the fireplace damper as the damper is opened in preparation of starting a fire in the fireplace.

4. The mechanism as described in claim 3, wherein said second metal strip is mounted in a second pivot block and extends upwardly therefrom, said second pivot block having pivot pins attached to the sides of said housing, said second pivot block having a weighted L-shaped arm extending downwardly therefrom for pivoting against a pivot stop attached to the sides of said housing, said weighted arm pivoting said second pivot block and said second metal strip positioning said second metal strip in a spaced relationship to the side of and slightly below the bottom of the lower end portion of the rod when the rod is resting on top of said first metal strip.

5. A fireplace damper release mechanism for automatically allowing a damper to close after a fire has gone out in a fireplace, the damper including a fireplace damper connecting rod having an upper end portion and a vertical lower end portion, the upper end portion of the rod attached to the damper, the damper opened and closed by manually raising and lowering the rod, the mechanism comprising:

a housing mounted in the fireplace for receiving the lower end portion of the rod;

a first elongated bimetallic thermostatic metal strip vertically disposed and pivotally mounted in said housing, the bottom of the lower end portion of the rod disposed directly above said first metal strip and resting thereon, the rod holding the damper in an open position while starting a fire in the fireplace, said first metal strip flexing with an increase in temperature away from the bottom of the lower end portion of the rod thereby allowing the rod to drop downward; and a second elongated bimetallic thermostatic metal strip vertically disposed adjacent said first metal strip and pivotally mounted in said housing, said second metal strip constructed to flex more rapidly than said first metal strip when the temperature increases in the fireplace, said second metal strip positioned below the bottom and in a spaced relationship to one side of the lower end portion of the rod, said first metal strip flexing with an increase in temperature toward the center of the bottom of the lower end portion of the rod and directly below for receiving the rod thereon when the rod is released by said first metal strip;

said second metal strip flexing with a decrease in temperature when the fire has gone out in the fireplace and flexing away from the center of the bottom of the lower end portion of the rod and returning to its original position thereby allowing the rod to drop downward closing the fireplace damper.

* * * * *